US005498005A

United States Patent [19]

Jacques

[11] Patent Number: 5,498,005

[45] Date of Patent: Mar. 12, 1996

[54] CIRCULAR PEGBOARD STRATEGY GAME

[76] Inventor: Alexander A. Jacques, 5656 Wood St., Port Orange, Fla. 32127

[21] Appl. No.: 344,018

[22] Filed: Nov. 23, 1994

[51] Int. Cl.[6] ..... A63F 3/00

[52] U.S. Cl. ..... 273/248; 273/287

[58] Field of Search ..... 273/248, 249, 273/287, 283–285, 273

[56] References Cited

U.S. PATENT DOCUMENTS

| | | | |
|---|---|---|---|
| 695,303 | 3/1902 | Graham | 273/249 |
| 2,787,469 | 4/1957 | Glover | 273/248 |
| 3,347,460 | 10/1967 | Dickson | 273/284 |
| 4,752,227 | 6/1988 | Yamin | 273/273 |

*Primary Examiner*—Benjamin H. Layno

[57] ABSTRACT

A circular pegboard strategy game comprising a playing board formed in a generally rectangular configuration with an upper surface and a lower surface, the board having several large circles of varying diameters imprinted on its upper surface, the area between the two outer circles including a plurality of generally circular peg holes, the peg holes being arranged in a plurality of sets, each set having several peg holes, a plurality of start/end blocks being positioned around the board and including several radially extending peg holes, a plurality of plastic pegs formed in a long generally spherical configuration, the pegs being arranged in four separate color groups, a standard set of playing cards consisting of fifty-two separate cards, a set of written instructions informing the users how to play the game, the ultimate object of the game being to get four pegs out of jail and into the end block.

5 Claims, 4 Drawing Sheets

FIG. 1
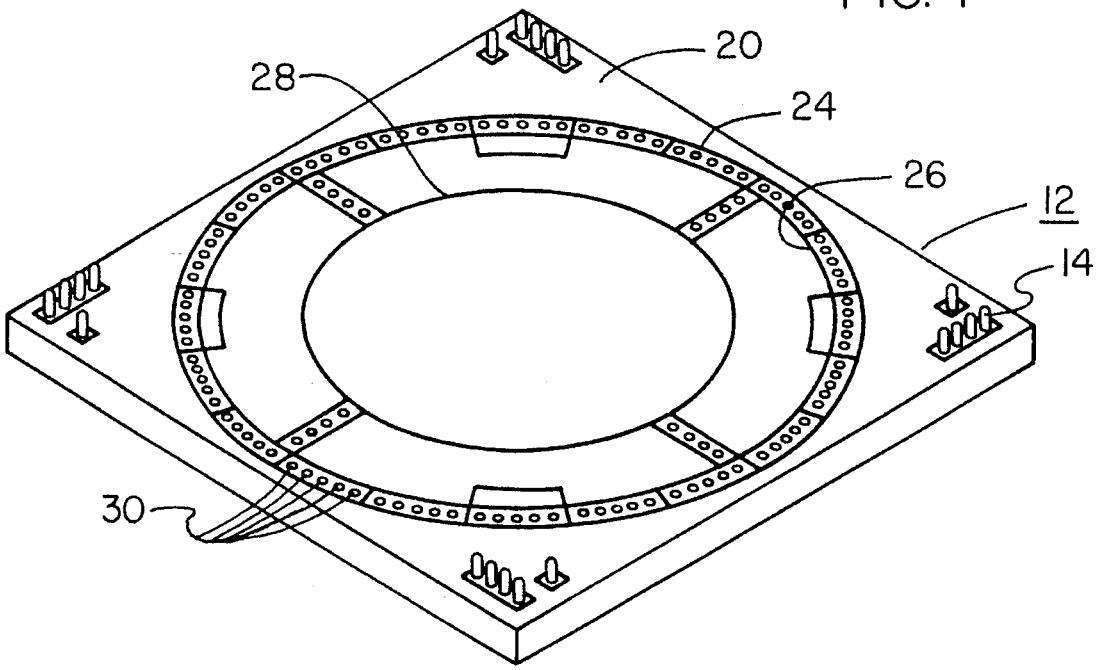
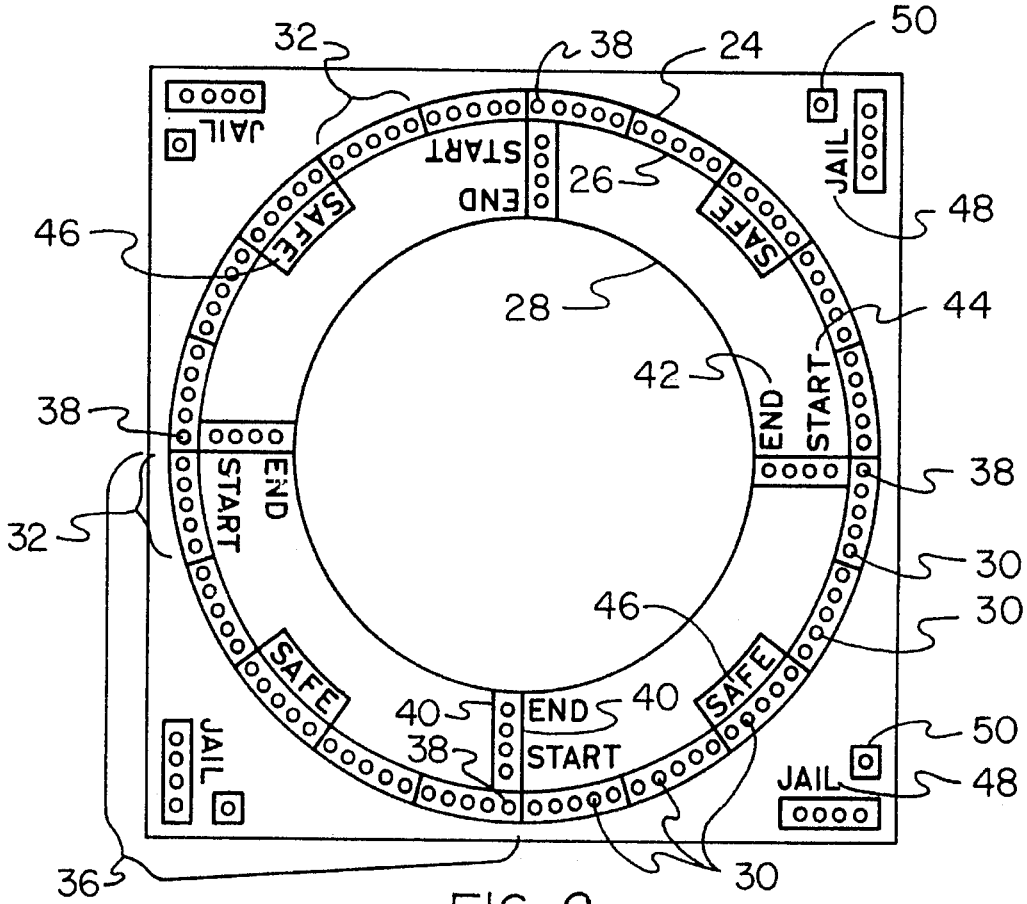
FIG. 2

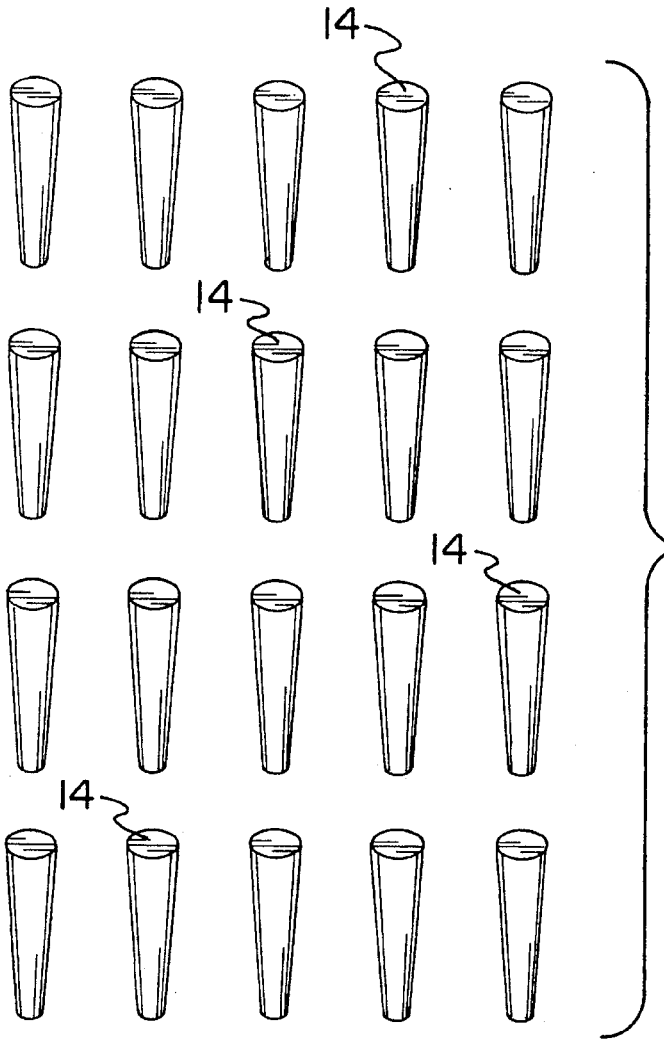
FIG. 3
FIG. 4
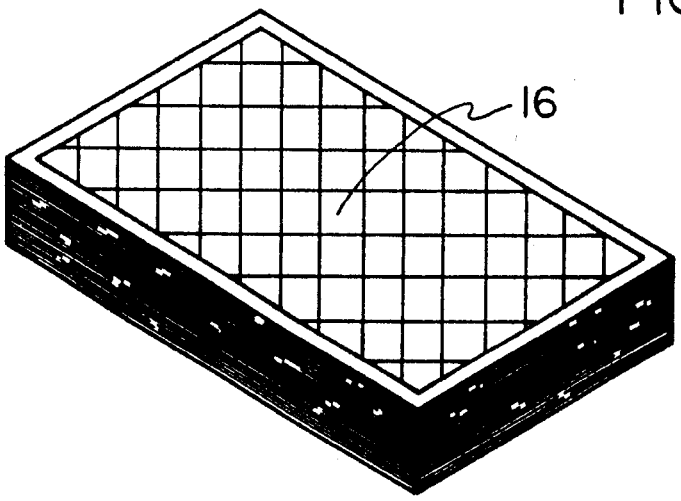

CIRCULAR PEGBOARD STRATEGY GAME

BACKGROUND OF THE INVENTION

Field of the Invention

The present invention relates to a circular pegboard strategy game and more particularly, pertains to utilizing a standard deck of playing cards to achieve the desire objective of strategically moving four pegs to the end block of the board.

Description of the Prior Art

The use of board games utilizing playing cards is known in the prior art. More specifically, board games utilizing playing cards heretofore devised and utilized for the purpose of entertaining two or more participants by playing and competing according to the rules of the games are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,028,765 to Hull a give-a-way and cribbage game board.

U.S. Pat. No. 3,623,730 to Goldfarb discloses a card game and method of playing same.

U.S. Pat. No. 4,363,302 to Gardner discloses a board game utilizing playing cards.

U.S. Pat. No. 5,037,108 to Banasky discloses a method of playing cards game.

Lastly, U.S. Pat. No. 5,108,110 to Nerbas discloses a game apparatus.

In this respect, the circular pegboard strategy game according to the present invention substantially departs from the conventional concepts and designs of the prior art, and in doing so provides an apparatus primarily developed for the purpose of utilizing a standard deck of playing cards to achieve the desired objective of strategically moving four pegs to the end block of the board.

Therefore, it can be appreciated that there exists a continuing need for a new and improved circular pegboard strategy game which utilizes a standard deck of playing cards to achieve the desired objective of strategically moving four pegs to the end block of the board. In this regard, the present invention substantially fulfills this need.

SUMMARY OF THE INVENTION

In view of the foregoing disadvantages inherent in the known types of board games utilizing playing cards now present in the prior art, the present invention provides an improved circular pegboard strategy game. As such, the general purpose of the present invention, which will be described subsequently in greater detail, is to provide a new and improved circular pegboard strategy game and method which has all the advantages of the prior art and none of the disadvantages.

To attain this, the present invention essentially comprises a new and improved circular pegboard strategy game comprising, in combination: a playing board formed in a generally rectangular configuration with an upper surface, a lower surface, and a small thickness therebetween, the board having large circles imprinted on its upper surface, a first circle being the largest and having its outer edge positioned a short distance from each side edge of the playing board, a second circle having a slightly smaller diameter than the first circle and positioned therewithin, a third circle having only between about fifty and seventy-five percent of the diameter of the first circle and positioned at the center thereof, the area between the first and second circles including a plurality of centrally positioned circular peg holes, the peg holes being arranged in twenty sets of five bore holes each, each set being separated by a radially positioned line, the peg holes being further arranged into quartile groups of five sets which span one-quarter of the circumference of each circle, the last peg hole of each quartile group having a start/end block comprising of four peg holes extending approximately radially therefrom between the second and third circles, the start/end blocks having lines on either side and including the words "End" and "Start" positioned counterclockwise therefrom, the center set of bore holes of each quartile group including the word "Safe" written thereabove, the lower right-hand corner of each side edge of the board including the word "Jail" printed parallel thereto, one peg hole with a square therearound being positioned to the right of "Jail" and four peg holes with a square therearound being positioned beneath Jail; the playing board having a lower surface including three semispherical shaped rubber foot pads positioned in a triangular configuration, the foot pads including screws positioned within the board, the central portion of the lower surface of the board including a generally rectangular shaped recessed storage area, the storage area being adapted to house accessories of the apparatus, the storage area having a plate covering it, the plate having a plurality of screw holes around its perimeter, the plate having a semicircular shaped rotatable cover split into two separate pieces, a first piece including a rotatable axle and coupling means to permit secure fastening to the first piece; a plurality of plastic pegs formed in a long generally spherical configuration, the pegs being arranged in four separate color groups, the pegs adapted to be moved from one peg hole to another to achieve the ultimate objective of placement in an end block of the board; a standard set of playing cards consisting of fifty-two separate cards, the cards indicating how many moves the pegs are to be advanced during play of the game; and a set of written instructions informing the users how to play the game, the game to be played by two to four players, each player receiving a different color set of pegs and beginning by positioning them in the jail block, in a two-player game each player being dealt six cards initially and then five in each round thereafter, in a three-player game each player being dealt five cards initially and then four cards thereafter, in a four-player game each player being dealt five cards initially and four cards thereafter, a player being able to leave the jail position and enter the circular area of the board when he plays either an Ace or a King from his hand, the pegs being moved thereafter in a counter clockwise direction around the board based on the value of the card played, a player landing on another player's peg causing the opponent's peg to go back to the jail block, a player being prohibited from jumping over his own peg or pegs at anytime, the ultimate object of the game being to get four pegs out of jail and into the end block.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved circular pegboard strategy game which has all the advantages of the prior art board games utilizing playing cards and none of the disadvantages.

It is another object of the present invention to provide a new and improved circular pegboard strategy game which may be easily and efficiently manufactured and marketed.

It is further object of the present invention to provide a new and improved circular pegboard strategy game which is of durable and reliable constructions.

An even further object of the present invention is to provide a new and improved circular pegboard strategy game which is susceptible of a low cost of manufacture with regard to both materials and labor, and which accordingly is then susceptible of low prices of sale to the consuming public, thereby making such circular pegboard strategy game economically available to the buying public.

Still yet another object of the present invention is to provide a new and improved circular pegboard strategy game which provides in the apparatuses and methods of the prior art some of the advantages thereof, while simultaneously overcoming some of the disadvantages normally associated therewith.

Still another object of the present invention is to utilize a standard deck of playing cards to achieve the desired objective of strategically moving four pegs to the end block of the board.

Lastly, it is an object of the present invention to provide a new and improved circular pegboard strategy game comprising a playing board formed in a generally rectangular configuration with an upper surface and a lower surface, the board having several large circles of varying diameters imprinted on its upper surface, the area between the two outer circles including a plurality of generally circular peg holes, the peg holes being arranged in a plurality of sets, each set having several peg holes, a plurality of start/end blocks being positioned around the board and including several radially extending peg holes, a plurality of plastic pegs formed in a long generally spherical configuration, the pegs being arranged in four separate color groups, a standard set of playing cards consisting of fifty-two separate cards, a set of written instructions informing the users how to play the game, the ultimate object of the game being to get four pegs out of jail and into the end block.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the circular pegboard strategy game constructed in accordance with the principles of the present invention.

FIG. 2 is a top plan view of the apparatus shown in FIG. 1.

FIG. 3 is an exploded perspective view of the plastic pegs of the apparatus.

FIG. 4 is a perspective view of a standard deck of playing cards which is included in the circular pegboard strategy game.

The same reference numerals refer to the same parts through the various Figures.

DESCRIPTION OF THE PREFERRED EMBODIMENT

Figure 5:
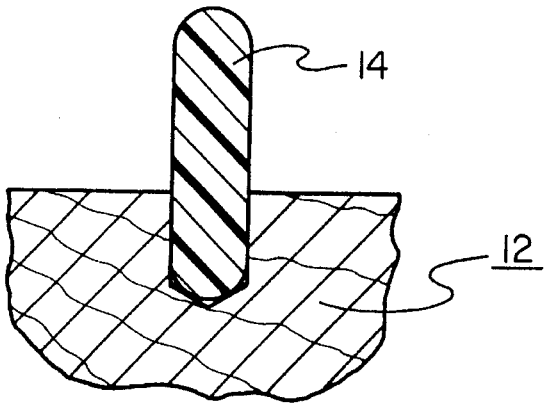
FIG. 5 is a cross-sectional view of a peg positioned in a circular peg hole within the board of the apparatus.

With reference now to the drawings, and in particular to FIG. 1 thereof, the preferred embodiment of the new and improved circular pegboard strategy game embodying the principles and concepts of the present invention and generally designated by the reference numeral 10 will be described.

The present invention, the circular pegboard strategy game is comprised of a plurality of components. Such components in their broadest context include a playing board 12, plastic pegs 14, playing cards 16, and a set of written instructions 18. Such components are individually configured and correlated with respect to each other so as to attain the desired objective.

More specifically, the playing board 12 is formed in a generally rectangular configuration with an upper surface 20, a lower surface 22, and a small thickness therebetween. The thickness of the board measuring about three-quarters of an inch. Each side edge of the board measures about twelve inches in length. The board is fabricated of sturdy materials to provide strength and stability to the apparatus. The board has three large circles 24, 26, 28, imprinted on its upper surface. A first circle 24 is the largest and has its outer edge positioned a short distance from each side edge of the playing board. The circles are printed in black to aid visibility. Note FIGS. 1 and 2.

A second circle 26 has a slightly smaller diameter than the first circle and is positioned therewithin. The second circle is positioned centrally within the first circle. A third circle 28 has only between about fifty and seventy-five percent of the diameter of the first circle and is positioned at the center thereof. The area between the first and second circles includes a plurality of centrally positioned, generally circular shaped peg holes 30. The peg holes extend a short distance within the board. The peg holes are arranged in twenty sets 32 of five bore holes each. Each set is separated by a radially positioned line 34. The peg holes are further arranged into quartile groups 36 comprised of five sets. Each quartile group spans one-quarter of the total circumference of each circle. There are a total of one hundred peg holes positioned adjacent to the perimeter of the first and second circles. Note FIGS. 1 and 2.

The last peg hole 38 of each quartile group has a set of four peg holes extending radially therefrom between the second and third circles. The radially extending peg holes have lines 40 on either side and include the words "End" 42 and "Start" 44 positioned counterclockwise therefrom. The radially extending peg holes are referred to as the start and end block of the game. Each player begins his trek around the board from the start block. The object of the game is to get four pegs out of jail and into the end block. Note FIGS. 1 and 2.

The center set of peg holes of each quartile group includes the word "Safe" 46 written thereabove. The lower right-hand corner of each side edge of the board includes the word "Jail" 48 printed parallel thereto. One peg hole 50 has a square therearound and is positioned to the right of Jail. Four peg holes 52 have a square therearound and are positioned beneath Jail. The pegs are positioned in the Jail block and adjacent single hole to start the game. The pegs are moved to the Start/End block only after the player plays an Ace or King from his hand. Note FIG. 2.

Figure 6:
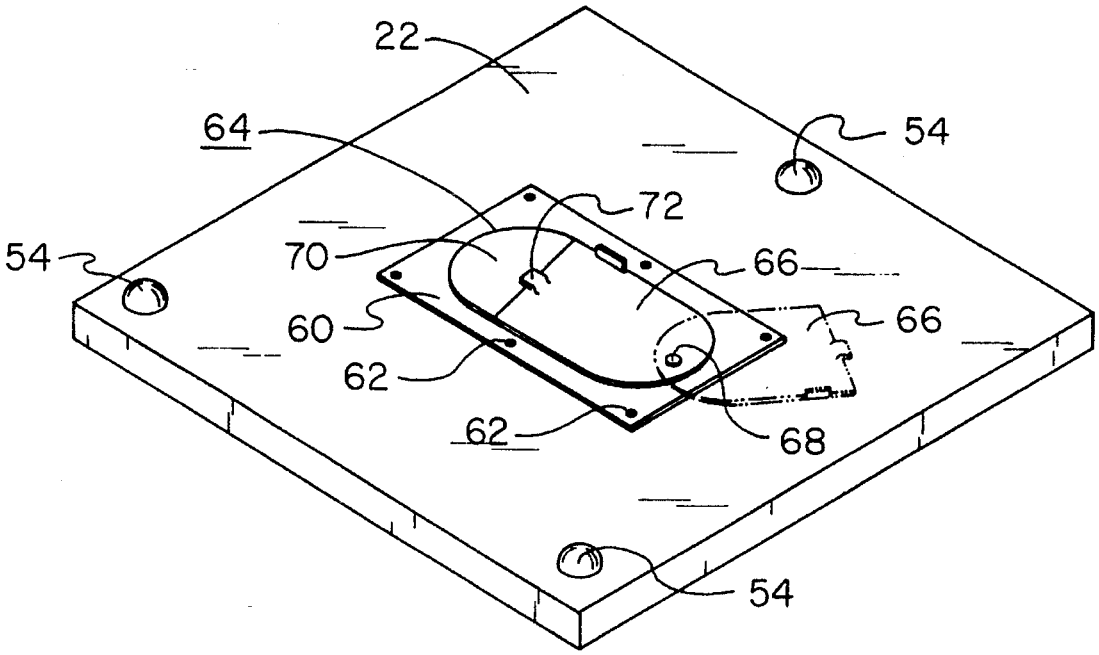
FIG. 6 is a bottom plan view of the apparatus illustrating the rubber foot pads and rotatable storage area cover of the apparatus.
Figure 7:
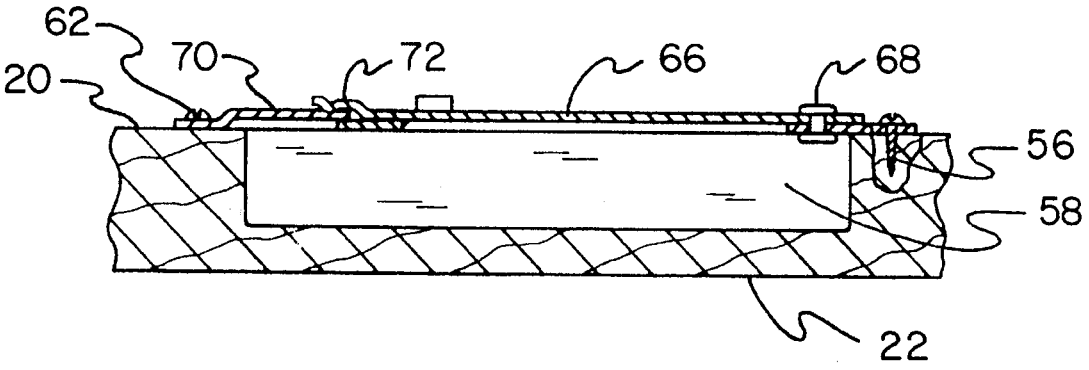
FIG. 7 is a cross-sectional view of the storage area and its cover.
Figure 8:
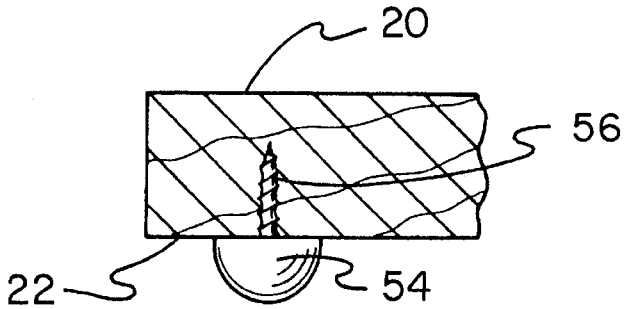
FIG. 8 is a cross-sectional view of one of the rubber foot pads of the apparatus.

The board has a lower surface which includes three semispherical shaped rubber foot pads 54 with screws 56 extending therefrom. The screws are positioned within the board. Two foot pads are positioned in corners of the board with one being positioned at the center point of the opposing side edge. The rubber foot pads prevent scratching of table surfaces. Note FIGS. 6, 7 and 8.

The central portion of the lower surface of the board includes a generally rectangular shaped recessed storage area 58. The storage area is adapted to house accessories of the apparatus when not in use. The playing cards, pegs and written instructions fit neatly therewithin. The storage area has a generally rectangular planar shaped plate 60 covering it. The plate has a plurality of screw holes around its perimeter to permit affixation with cooperatively coupled screws 62. The center of the plate has a generally oval shaped cover 64. The cover is split into two separate semicircular shaped pieces 66–70. A first piece 66 rotates about an axle 68 at one end permitting the user to swing it open to gain access the storage area. The first piece 66 includes coupling means 72 to permit fastening of the first piece 66 to the second piece 70 in a closed position. The accessories of the game can be easily removed and replaced due to the convenient construction of the cover. Note FIGS. 6 and 7.

A plurality of plastic pegs 14 are formed in a long generally spherical configuration. The pegs are arranged in four separate color groups. Each player has a different color during play of the game. Each player begins by placing his pegs in the Start/End block of the board. The pegs are adapted to be positioned in any of the peg holes in the playing board. The pegs are adapted to be moved from one peg hole to another to achieve the ultimate objective of placement in each players corresponding Start/End block. All of the peg holes are the same height, width and depth. Note FIGS. 1 and 5.

A standard set of playing cards 16 consists of fifty-two separate cards with different numbers and designs. Thirteen sets, consisting of four cards each, contain the same numerical value. The cards indicate how many moves the pegs are to be advanced during play of the game. Additionally, the cards permit each player to advance their respective pegs from the jail block and into the end/start block. Note FIG. 4.

Figure 9:
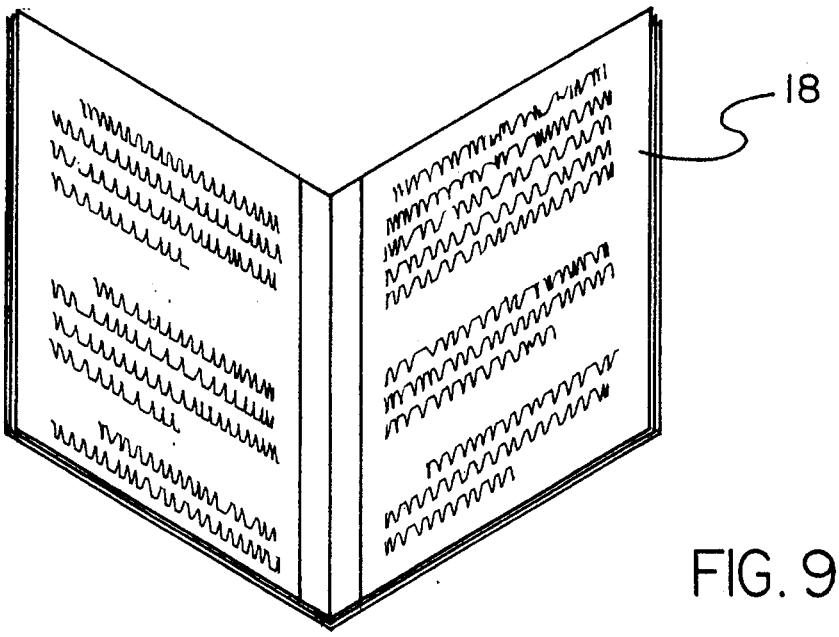
FIG. 9 is a perspective view of the set of written instructions of the apparatus.

A set of written instructions 18 inform the users how to play the game. The game may be played by two to four players. When play begins, each player receives a different color set of pegs and positions them in the jail block. In a two-player game each player is dealt six cards initially and then five in each round thereafter. In a three-player game each player is dealt five cards initially and then four cards thereafter. In a three player game, one card remains after the last deal. This card goes to the dealer. In a four-player game each player is dealt five cards initially and then four cards thereafter. Each of the players is assigned a Start/End block at the beginning of the game. Note FIG. 9.

In order for a player to leave the jail position and enter the circular area of the board, he must play either an Ace or a King from his hand. The pegs are moved thereafter in a counter clockwise direction around the board. An Ace card is worth one move, a Jack eleven, and the number cards are worth their face value in moves. A four card may be used only to move back four places. The four card cannot be used to back out of the end block at anytime. A Queen may be used to exchange a player's peg position with any other player's peg on the board. The peg positioned in the free standing peg hole adjacent to the jail block is used to make Queen exchange. The exception to the Queen rule being that the opponent's pegs which are located in the safe block are not subject to exchange. The Queen rule adds an additional element of strategy and uncertainty to the game. Note FIGS. 1 and 2.

If a player lands on another player's peg while moving, the opponent's peg is eliminated, except when positioned in the safe block. If the opponents peg is landed on while positioned outside of a safe block, then the opponent's peg is sent back to the jail block. An Ace or King is then required to be played in order to get that peg back to the Start/End block to begin its trek around the board anew. A player is prohibited from jumping over his own peg or pegs at anytime during play of the game. The ultimate object of the game is to get four pegs out of jail and into the end block. The start/end block is the position where the players start their trek around the board. The game provides entertainment, strategy, and challenge to the participants therein. Note FIGS. 1 and 2.

In an alternative embodiment of the apparatus the side edges of the playing board measure between four and ten inches. In such embodiment the apparatus is formed in two pieces and adapted to be folded in half for easy storage and transport. The smaller and more portable embodiment of the apparatus is ideally suited for two players. However, in a further alternative embodiment of the apparatus the small portable board has two additional end blocks to permit play by four players.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved circular pegboard strategy game comprising, in combination:

a playing board formed in a generally rectangular configuration with an upper surface, a lower surface, and a small thickness therebetween, the board having large circles imprinted on its upper surface, a first circle being the largest and having its outer edge positioned a short distance from each side edge of the playing board, a second circle having a slightly smaller diameter than the first circle and positioned therewithin, a third circle having only between about fifty and seventy-five percent of the diameter of the first circle and positioned at the center thereof, the area between the first and second circles including a plurality of centrally positioned circular peg holes, the peg holes being arranged in twenty sets of five bore holes each, each set being separated by a radially positioned line, the peg holes being further arranged into quartile groups of five sets which span one-quarter of the circumference of each circle, the last peg hole of each quartile group having a start/end block comprising of four peg holes extending approximately radially therefrom between the second and third circles, the start/end blocks having lines on either side and including the words "End" and "Start" positioned counterclockwise therefrom, the center set of bore holes of each quartile group including the word "Safe" written thereabove, the lower right-hand corner of each side edge of the board including the word "Jail" printed parallel thereto, one peg hole with a square therearound being positioned to the right of "Jail" and four peg holes with a square therearound being positioned beneath Jail;

the playing board having a lower surface including three semispherical shaped rubber foot pads positioned in a triangular configuration, the foot pads including screws positioned within the board, the central portion of the lower surface of the board including a generally rectangular shaped recessed storage area, the storage area being adapted to house accessories of the apparatus, the storage area having a plate covering it, the plate having a plurality of screw holes around its perimeter, the plate having an oval shaped cover split into two separate semicircular shaped pieces, a first piece an axle to permit rotation of the first piece to an open position, and the first piece also including a coupling means to permit secure fastening of the first piece to the second piece in a closed position;

a plurality of plastic pegs formed in a long generally spherical configuration, the pegs being arranged in four separate color groups, the pegs adapted to be moved from one peg hole to another to achieve the ultimate objective of placement in an end block of the board;

a standard set of playing cards consisting of fifty-two separate cards, the cards indicating how many moves the pegs are to be advanced during play of the game; and a set of written instructions informing the users how to play the game, the game to be played by two to four players, each player receiving a different color set of pegs and beginning by positioning them in the jail block, in a two-player game each player being dealt six cards initially and then five in each round thereafter, in a three-player game each player being dealt five cards initially and then four cards thereafter, in a four-player game each player being dealt five cards initially and four cards thereafter, a player being able to leave the jail position and enter the circular area of the board when he plays either an Ace or a King from his hand, the pegs being moved thereafter in a counter clockwise direction around the board based on the value of the card played, a player landing on another player's peg causing the opponent's peg to go back to the jail block, a player being prohibited from jumping over his own peg or pegs at anytime, the ultimate object of the game being to get four pegs out of jail and into the end block.

2. A circular pegboard strategy game comprising:

a playing board formed in a generally rectangular configuration with four corners, an upper surface and a lower surface, the board having several large circles of varying diameters imprinted on its upper surface, the area between the two outermost circles including a plurality of generally circular peg holes arranged in one contiguous row, the peg holes being arranged in a plurality of sets, each set having several peg holes, a plurality of start/end blocks being positioned around the board and including several radially extending peg holes arranged in one contiguous row, each of the four corners of the game board including a plurality of peg holes encased within a rectangular structure and positioned in parallel orientation with a side edge of the game board, a plurality of plastic pegs formed in a long generally spherical configuration, the pegs being arranged in four separate color groups, a standard set of playing cards consisting of fifty-two separate cards, a set of written instructions informing the users how to play the game, the ultimate object of the game being to get four pegs out of jail and into the end block; and the lower surface of the board including a recessed storage area, the storage area being adapted to house accessories of the apparatus, the storage area having a plate covering it, the plate having a plurality of screw holes around its perimeter, the plate having an oval shaped cover split into two separate semicircular shaped pieces, a first piece including an axle to permit rotation of the first piece to an open position, and the first piece also including a coupling means to permit secure fastening of the first piece to the second piece in a closed position.

3. The apparatus as set forth in claim 2 wherein the side edges of the playing board measure between four and ten inches and is adapted to be folded in half for easy storage and transport.

4. The apparatus as set forth in claim 2 and further including:

a plurality of rubber foot pads are positioned on the lower surface of the board, the rubber foot pads having a semispherical shaped portion with a screw extending therefrom, the screws being positioned within the board.

5. The apparatus is set forth in claim 2 wherein each set consists of five peg holes, the circular area between each start/end block consisting of five sets, each start/end block including of four peg holes, each jail block consisting of four adjacent peg holes and one free standing peg hole, the safe block consisting of five peg holes and being positioned equidistantly between any two start/end blocks.

* * * * *